US005943963A

United States Patent [19]

Beals

[11] Patent Number: 5,943,963

[45] Date of Patent: Aug. 31, 1999

[54] COMBINATION LADING TIE-DOWN STRAP AND PROTECTIVE SHIELD THEREFOR

[75] Inventor: Stephen H. Beals, Libertyville, Ill.

[73] Assignee: Ireco Incorporated, Chicago, Ill.

[21] Appl. No.: 08/953,957

[22] Filed: Oct. 10, 1997

[51] Int. Cl.[6] ..... B61D 3/00; B61D 45/00

[52] U.S. Cl. ..... 105/355; 410/99

[58] Field of Search ..... 105/355; 428/36.1, 428/36.3, 100, 193; 410/96, 97, 99; 24/287, 265 CD, 17 R, 17 A, 17 B, 18; 224/309; 296/100.01, 100.15

[56] References Cited

U.S. PATENT DOCUMENTS

| | | | |
|---|---|---|---|
| 3,941,159 | 3/1976 | Toll . | |
| 4,402,489 | 9/1983 | Murray . | |
| 4,436,466 | 3/1984 | Marino . | |
| 4,864,698 | 9/1989 | Brame . | |
| 5,050,924 | 9/1991 | Hansen | 296/100.15 |
| 5,086,543 | 2/1992 | Mitchell . | |
| 5,114,010 | 5/1992 | Smith . | |
| 5,178,923 | 1/1993 | Andrieu et al. . | |
| 5,300,337 | 4/1994 | Andrieu et al. . | |
| 5,326,202 | 7/1994 | Stubbs | 24/17 A |
| 5,441,790 | 8/1995 | Ratigan . | |
| 5,535,787 | 7/1996 | Howell . | |
| 5,584,623 | 12/1996 | Nadherny | 410/99 |
| 5,603,591 | 2/1997 | McLellan . | |

OTHER PUBLICATIONS

Flatbed Accessories and Parts, Ancra International, pp. 9–10, Aug. 1990.

*Primary Examiner*—Mark T. Le

*Attorney, Agent, or Firm*—Lockwood, Alex, FitzGibbon & Cummings

[57] ABSTRACT

In combination with a lading tie-down strap a shield for protecting the strap where it passes cover a corner of lading stacked on the flatbed of a cargo vehicle, e.g. a bulkhead railway flatcar. At least one end of each lading tie-down strap will be wound on a winch mounted on a side of the flatbed. The shields are formed from pieces of fabric or the like which are foldable into sleeves embracing the tie-down straps. When embracing a tie-down strap a shield sleeve must be sufficiently flexible so as to be windable on a winch along with the strap. Strips of Velcro-tape on the shields serve to releasably retain the shields on the tie-down straps.

5 Claims, 1 Drawing Sheet

COMBINATION LADING TIE-DOWN STRAP AND PROTECTIVE SHIELD THEREFOR

This invention relates to a lading tie-down strap and protective shield combination for use on cargo transporting vehicles having flatbeds on which lading may be stacked with a plurality of winches mounted on and along at least one side of each flatbed on which the lading tie-down straps and protective shields can be wound.

In the transportation of cargo stacked on the flatbed of a vehicle such as a rail car, motor truck or trailer it is common practice to tie down the cargo during transport so as to prevent it from shifting or coming apart. Tie-down straps formed of a wear and weather resistant material such as woven nylon are extensively used for tying down cargo. A plurality of straps are commonly used with one end of each strap coiled or wound on a winch mounted on one side of the flatbed while the other end of the strap is wound on another winch on the opposite side, or otherwise anchored to the opposite side. Prior to transport of cargo the tie-down straps are passed over the opposite sides and top of the lading on a flatbed and then tightened by means of one of the winches. Depending upon the nature of the cargo, unless shielded, the tie-down straps are subjected to more or less extensive wear in the locations where they pass over the corners of the lading stacked on a flatbed.

In order to protect the tie-down straps and extend their life various forms of shields have been proposed for attachment to the tie-down straps in order to protect the relatively short length portions of the straps which pass over a corner of the lading, these being the locations where significant wear usually occurs.

While it is desirable that the shields on lading tie-down straps can be readily put in place and removed, it is usually desirable that these shields remain on the straps so that they will be in place when needed. This requirement makes it highly desirable that the protective shields for lading tie-down straps be sufficiently flexible so that they can be wound on the winches along with the straps themselves.

In view of the foregoing considerations an important object of the present invention is the provision of lading tie-down strap systems comprising a combination of lading tie-down straps and protective shields thereon which are convenient in use and economical and effective for the purpose intended. Shields which have been found entirely satisfactory for use in accordance with the present invention have comprised a rectangular piece of wear and weather resistant fabric such as four ply nylon to the opposing edges of which strips of co-acting Velcro tape are attached so that the fabric can be formed into a removable sleeve embracing a lading tie-down strap.

Other objects of the invention will become apparent from the following detailed description of a presently preferred embodiment taken in conjunction with the accompanying drawings, wherein.

Figure 1:
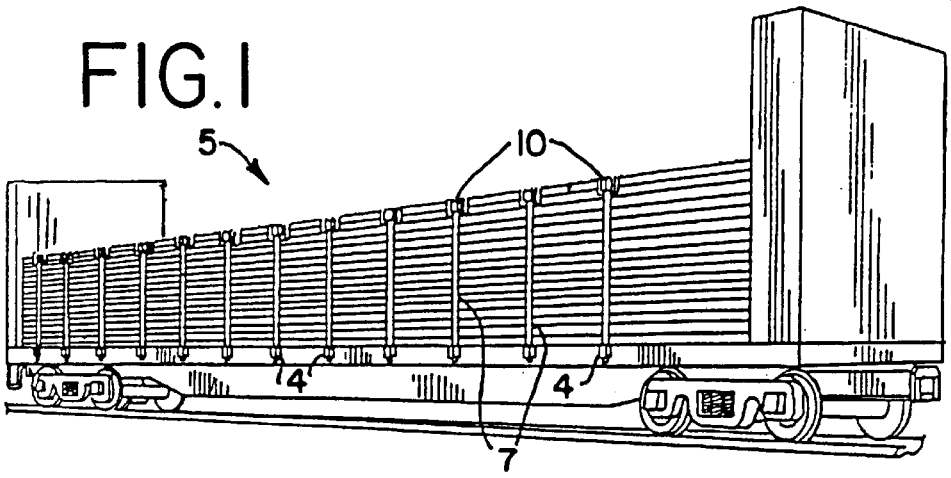
FIG. 1 is a perspective view of bulkhead railway flat car loaded with lading and illustrating a typical use of the present invention.

Referring to FIG. 1, a bulkhead railway flatcar ia indicated generally at 5. The car 5 is shown loaded with lading on its flatbed tied down on both sides and the top by a plurality of tie-down straps 7—7. These straps may be in the form of nylon webbing which is longlasting and durable under normal conditions of usage. Nylon webbing is a preferred material for the tie-down straps since it does not stretch appreciably under tension and is wear and weather resistant. The nylon webbing may be impregnated, coated or laminated with substances or materials which impart desired coefficients of friction or other desirable properties. The straps 7 can be formed of materials other than nylon or blends of nylon, which other materials give the straps desired properties.

In accordance with known practice, ends of the tie-down straps are shown wound on winches 4—4 mounted in known manner on the sides of the car 5. When not in use with lading, the tie-down straps 7 can remain attached when tightened sufficiently so that they will remain in place for subsequent use. Both sides of the railcar 5 may be provided with the winches 4 or they may be provided on one side only and the other side equipped with fixtures to which the ends of the lading tie-down strap 7 may be anchored.

Figure 2:
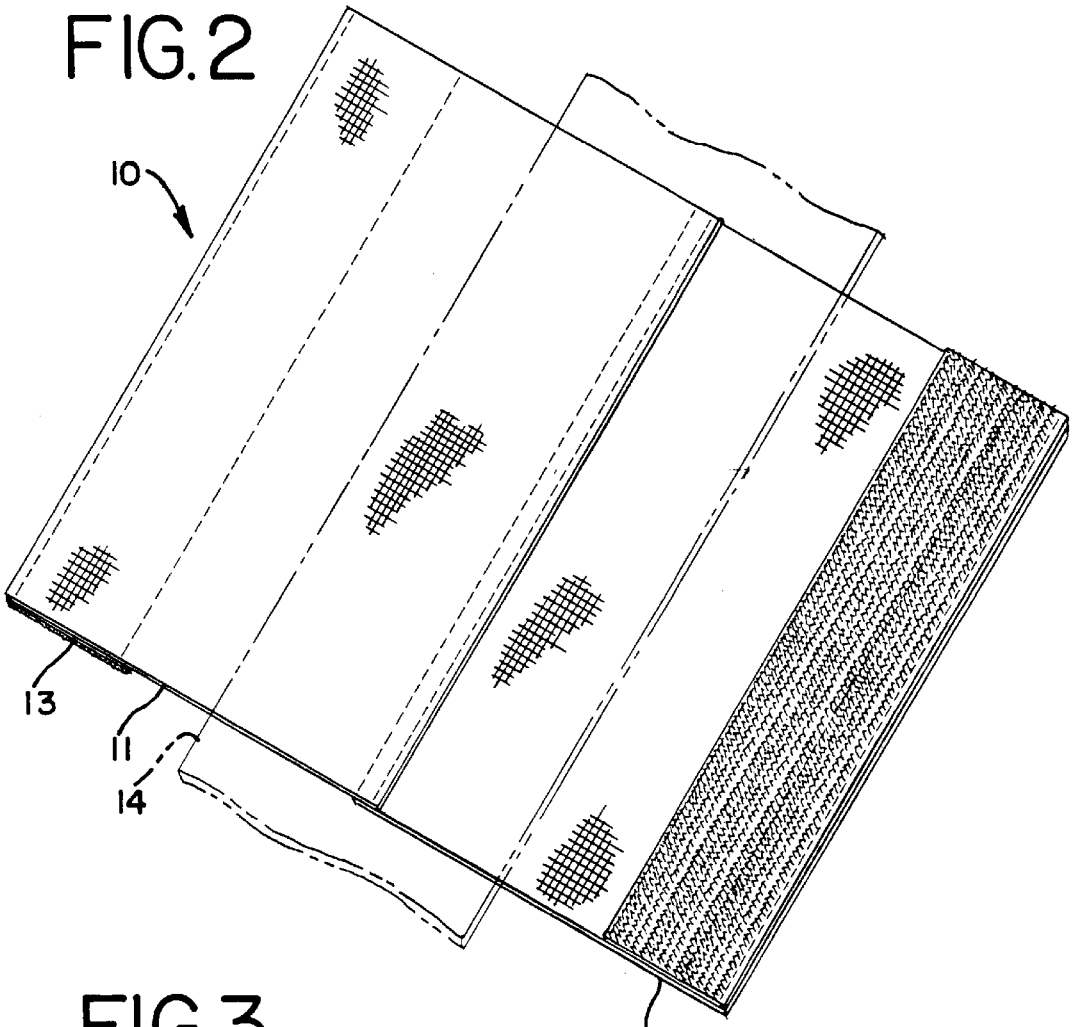
FIG. 2 is a plan view of a shield for a lading tie-down strap showing the shield in its fully open position and showing in broken line a lading tie-down strap in position on the shield.
Figure 3:
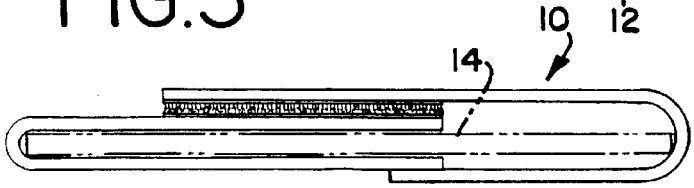
FIG. 3 is an end elevational view showing the shield of FIG. 2 embracing a lading tie-down strap shown in broken line.

Referring to FIGS. 2 and 3, one of the lading tie-down strap shields 10 of FIG. 1 is shown comprised of a rectangular piece of material 11 such as four ply nylon webbing. Stitched, or otherwise secured to one side and edge of the piece of nylon 11 is a strip of Velcro tape 12 while on the opposite side (underside as shown) along the opposite edge a second Velcro strip 13 is secured. One of the Velcro strips 12 or 13 is of the hook type while the other is of the hook-receiving type. In place of Velcro tape or comparable material, other forms of adhere-and-release materials, and other types of fasteners, may be secured to the opposite edges of the piece of nylon webbing 11.

In use a shield 10 may be applied to a lading tie-down strap 7 either before or after the tie-down strap has been installed on the railway car 5 or other cargo vehicle. In FIG. 3 one of the shields 10 is shown embracing a lading tie-down strap 14 shown in broken line. As shown in FIG. 3 the Velcro strips 12 and 13 are shown in full overlap engagement one with the other. However, full engagement is not required and normally engagement of only a portion of one of the Velcro strips 12 or 13 with a portion of the other will suffice. Thus, the Velcro strips 12 and 13 allow a shield 10 to be adjusted according to the width of the lading tie-down strap 14 so as to accommodate either wider or narrower tie-down straps.

By way of illustration, for use with a lading tie-down strap 14 having a width of approximately four inches, the shield 10 may be twelve inches wide measured transversely to the length of the strap 14 and have a length of ten inches parallel measured to the length of the strap 14. Each Velcro strip 12 and 13 may have a width of two inches. The shields 10 may be applied to the tie-down strap 7 sufficiently tightly so as to remain in one location on the strap until moved to a different location. Alternately, the shields may be applied to the lading tie-down straps 14 in a looser condition so that they can either be readily manually moved to a different location or even be free to slide on a strap without the application of appreciable force. Whether a shield 10 tightly or loosely embraces a lading tie-down strap 7, once applied to a strap the shield will remain on the strap until forcibly removed.

What is claimed is:

1. In combination with a cargo transporting vehicle having a flatbed on which lading may be stacked, a plurality of winches mounted on and along at least one side of said flatbed, and lading tie-down straps at least partially wound on said winches, the improvement, comprising, at least one lading tie-down strap shield removably embracing each said lading tie-down strap for protecting the strap where it passes over a corner of lading on a flatbed, each said shield being sufficiently flexible so as to be windable on one of said winches along with the lading tie-down strap which it embraces, and wherein said shield comprises a piece of foldable material having such size and flexibility as to be foldable into embracing relationship with a said lading tie-down strap while said strap is in its normal flat strap-like condition, and releasable fastening means on said piece of foldable material for retaining it in its said folded strap embracing relationship.

2. In the improvement called for in claim 1 wherein said foldable piece of material is a piece of fabric.

3. In the improvement called for in claim 2 wherein said foldable piece of material is nylon fabric.

4. In the improvement called for in claim 1 wherein said releasable fastening means is a hook tape.

5. In the improvement called for in claim 4 wherein said releasable fastening means is in the form of two strips of hook and hook-receiving tapes secured along opposite side edges of said piece of material with one strip being secured on one surface of said piece of material and the other strip being secured on the opposite surface.

* * * * *